US005105868A

United States Patent [19]

Riise

[11] Patent Number: 5,105,868

[45] Date of Patent: Apr. 21, 1992

[54] SLIDING-DOOR SECURITY SCREEN

[76] Inventor: Sharron E. Riise, 1635 E. Kleindale Rd., Tucson, Ariz. 85719

[21] Appl. No.: 737,387

[22] Filed: Jul. 29, 1991

[51] Int. Cl.[5] ..... A47H 1/00

[52] U.S. Cl. ..... 160/90; 160/179; 160/215; 160/369; 49/57; 49/168

[58] Field of Search ..... 160/180, 104, 105, 182, 160/116, 215, 217, 220, 181, 369, 371, 377, 90, 179; 49/57, 169, 171, 168

[56] References Cited

U.S. PATENT DOCUMENTS

| | | | |
|---|---|---|---|
| 994,279 | 6/1911 | Smith | 160/180 |
| 1,121,756 | 12/1914 | Patton | 160/220 |
| 1,370,214 | 3/1921 | Kaempffe | 160/182 |
| 1,496,594 | 6/1924 | Otto | 160/371 X |
| 1,619,501 | 3/1927 | Evans . | |
| 1,902,949 | 3/1933 | Condon | 160/217 X |
| 2,526,603 | 10/1950 | Damroth | 160/181 X |
| 3,053,566 | 9/1962 | Allen | 160/215 X |
| 3,464,158 | 9/1969 | Greene | 49/168 |
| 3,654,733 | 4/1972 | Blackwell | 49/168 |
| 3,811,224 | 5/1974 | Garrison | 49/168 |
| 3,878,645 | 4/1975 | Porter | 49/169 |
| 3,895,669 | 7/1975 | Heeling | 160/180 X |
| 4,127,156 | 11/1978 | Brandt | 160/369 X |
| 4,226,049 | 10/1980 | Maust | 49/57 |
| 4,478,002 | 10/1984 | English | 49/57 |
| 4,592,167 | 6/1986 | Andrawos | 160/180 X |
| 4,653,562 | 5/1987 | Moss | 160/105 |
| 4,913,212 | 4/1990 | Clavier | 160/105 |
| 5,048,587 | 9/1991 | York | 160/105 X |

*Primary Examiner*—David M. Purol

*Attorney, Agent, or Firm*—Antonio R. Durando; Harry M. Weiss

[57] ABSTRACT

A rectangular rigid lattice structure contained in a frame that is adapted to be inserted between the upper and lower trackways of a conventional sliding door, with one vertical side of the structure abutting the door jamb and the other vertical side abutting the outer edge of the sliding door. The latter vertical side is equipped with flanges that wrap around the edge of the sliding door and prevent the extraction of the insert without opening or also removing the door. Locking mechanisms suitable for cooperation with the lock and jamb plate of the sliding door may be provided on each side of the insert to fasten the assembly in a closed position. The lattice may constitute a large grille with ornamental features, a small mesh screen capable of preventing insects and small animals from entering the premises, or both.

17 Claims, 1 Drawing Sheet

SLIDING-DOOR SECURITY SCREEN

BACKGROUND OF THE INVENTION

1. Field of the Invention

This invention pertains to the general field of security ventilating systems for doors and windows in buildings. In particular, it provides a new and improved security screen for use in sliding doors, either as a permanent installation or as a temporary insert for natural ventilation.

2. Description of the Prior Art

People have been using screens in windows and doors for a long time in order to allow natural ventilation from outdoors while keeping insects and other animals outside. During the last few decades, because of an increasing concern with crime and personal safety, these screens have also often served the purpose of keeping intruders from entering the premises. Many different models of ventilation screens have been developed, ranging from the familiar sliding screen-door to the permanent burglar-proof wrought iron bars often found adorning the outside of many residential windows. Similarly, ventilation screens have been built into other functional apparatus, such as pet portals, for use on regular windows and doors, and the same screen concepts have been utilized for applications in other fields, such as in automobile windows.

For example, in U.S. Pat. No. 1,619,501 (1927), Evans discloses an early screen for automobile windows. It is designed to permit ventilation inside the vehicle while avoiding the draft associated with having the windows open during motion. This device is not particularly pertinent to the present invention, but it illustrates a way of affixing a screen structure to a framed opening.

U.S. Pat. No. 3,464,158 to Greene (1969) describes a pet portal for sliding doors that has functional features similar to the invention described herein. The pet portal is built into a vertical panel to be mounted on the tracks of the frame of the sliding door. The panel thus becomes an extension of the frame and reduces the useful travel of the door by a distance equal to its width. Latches on both sides of the panel make it possible to attach it to the jamb of the door frame as well as to the door itself. Thus, the panel can be treated as a permanent extension of the door frame or, if desired, it can be made to slide with the door.

U.S. Pat. No. 3,654,733 to Blackwell (1972) shows a similar pet-door panel for a sliding door frame. The panel insert is essentially the same as the one described above, but it differs in the design of the pet portal. With reference to the insert itself, the same functional features described in Greene are present here.

In U.S. Pat. No. 3,811,224 (1974), Garrison illustrates yet another pet-portal panel design for use as an insert in the frame of a conventional sliding door. This invention is distinguishable on the basis of its specific construction and the configuration of the pet door.

U.S. Pat. No. 4,226,049 to Maust (1980) discloses a security ventilation system that consists of a grille insert for sliding doors, but it is not suitable for use on the tracks of a standard door frame. It requires the permanent mounting of a support structure on the frame and on the sliding door to receive the grille upon use. It also requires the insertion of several screws into the existing door assembly and the drilling of locking stud holes into the frame.

Finally, U.S. Pat. Nos. 4,653,562 to Moss et al. (1987) and 4,913,212 to Clavier (1990) describe two other kinds of automotive safety window screens.

The main problem with existing screens for sliding doors is that they can be easily removed by a potential intruder by lifting them out of the door tracks, thus representing a security hazard for a user. In fact, the level of security required for the psychological comfort of most people is attained only by the installation of permanent bars or of semi-permanent structures, such as the screen shown by Maust. Therefore, there still exists a need for a new and improved, self-contained, security screen that can be quickly inserted into the opening of a conventional sliding door and securely fastened to prevent its unauthorized removal. This invention is directed to the achievement of these goals.

BRIEF SUMMARY OF THE INVENTION

One objective of this invention is a ventilation screen insert for standard sliding doors that provides maximum security against intrusion. This is achieved by structural features in the apparatus that make impossible for a potential intruder to extract it from the tracks of the sliding door without taking apart the entire assembly.

Another purpose of the invention is the ability to install it quickly and without the use of bolts or similar semi-permanent fastening devices. This is accomplished by encasing the screen as an insert into the tracks of the open sliding door and by latching it directly to the door itself and to its jamb.

Another objective of the invention is that it constitute a practical device for an average person to install, remove and store, so that each step can be managed single-handedly without any particular expertise. This is obtained by providing a relatively light-weight, foldable device that can be secured in place simply by inserting it into the open door tracks and latching it to existing door hardware.

A further goal of the invention is the ability to use the same device, without modification, with any sliding door normally encountered in residential and commercial buildings. For that purpose, the security screen consists of an insert whose dimensions match the thickness and height of all standard doors.

Yet another objective of this invention is the realization of the above mentioned goals in an economical and commercially viable manner. This is done by utilizing simple components that are either already available in the open market or can be produced at competitive prices.

According to these and other objectives, this invention consists of a rectangular rigid lattice structure contained in a frame adapted to be inserted between the upper and lower trackways of a conventional sliding door, with one vertical side of the structure abutting the door jamb and the other vertical side abutting the outer edge of the sliding door. The latter vertical side is equipped with flanges that wrap around the edge of the sliding door and prevent the extraction of the insert without opening or also removing the door. Locking mechanisms suitable for cooperation with the lock and jamb plate of the sliding door may be provided on each side of the insert to fasten the assembly in a closed position. The lattice may constitute a large grille, with ornamental features, or a small mesh screen, capable of preventing insects and small animals from entering the premises.

Various other purposes and advantages of this invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

Figure 1:
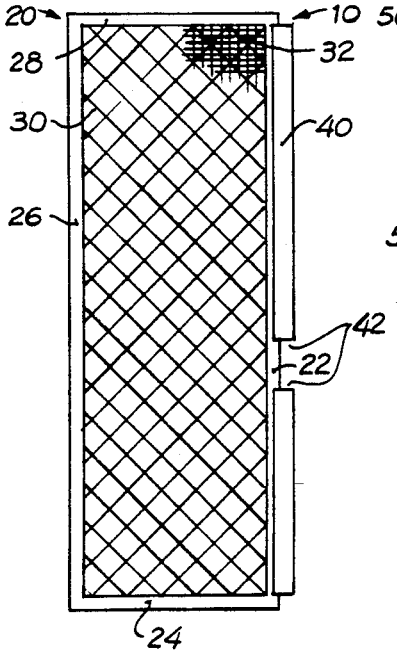
FIG. 1 illustrates an elevational front view of one embodiment of the sliding-door security screen of this invention, shown in isolation before insertion into the tracks of a sliding door.

The heart of this invention lies in the novel working relationship of the various components constituting, in combination, the functional structure of this security screen. Referring to the drawings, wherein like parts are designated throughout with like numerals and symbols, FIG. 1 illustrates a front elevational view of the preferred embodiment 10 of the invention shown in isolation, as it would appear before insertion into the tracks of a conventional sliding door. The screen insert 10 comprises a substantially rectangular frame 20, of the same height of the door for which it is intended, rigidly encasing a sturdy screen lattice 30. For use with standard residential doors, the preferred height is approximately 80 inches, which corresponds to the vertical size of such doors. The mesh of the lattice of the screen may be of any size considered acceptable for ornamental purposes, so long as it is sufficiently small to prevent the intrusion of people, animals, and objects in general. The construction of the lattice 30, whether it be in the form of a grille or of a smaller-mesh fabric, must be strong enough to provide the level of security generally expected from protective screens. Therefore, a rigid metal construction is recommended. Although not necessary to practice the invention, if protection from insects and smaller animals is also desired, an additional fine-mesh screen 32, of the type normally used in screen doors, may be overlaid on the lattice 30 (illustrated only in part in FIG. 1). It is to be noted, though, that the screen door normally mounted on the outside of standard sliding doors remains operable after the installation of the screen insert 10, so that the addition of the fine-mesh screen may not be necessary.

Figure 2:
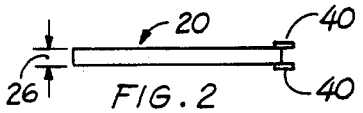
FIG. 2 illustrates a top view of the same embodiment of the security screen of the invention.

The optimal thickness 26 of the frame 20 (shown in the top view of FIG. 2) is uniform and the same as that of the sliding door for which it is intended, so that it provides a snug fit in the groove of its tracks and the groove in the door jamb. The width of the frame (and therefore of the insert 10) depends on the amount of opening desired for ventilation and is not a limiting feature of the invention. Of course, though, the horizontal portions 24 and 28 of the insert must be narrower than the sliding panel of the door, so that it can fit in its tracks while the door is open. In practice, aesthetic and practical considerations would normally limit the insert's width to one to three feet, which provides adequate ventilation while limiting the apparatus to a manageable size.

Figure 3:
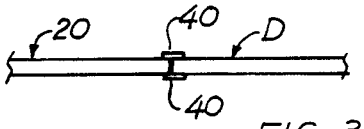
FIG. 3 is another top view of a portion of the invention showing its engagement with a sliding door.

The vertical portion 22 of the frame 20 facing the sliding door is equipped on both sides (interior and exterior) with vertical lateral flanges 40 designed to envelop the vertical edge of an abutting sliding door D, as illustrated in the top view of FIG. 3. These flanges are welded, bolted, or otherwise securely fastened to the frame 20 to ensure a strong cooperative engagement with the sliding door upon assembly of the security screen into the door frame. A discontinuity 42 in the length of the flanges is provided at the height corresponding to the sliding-door handle, so that the door can be pushed all the way against the edge of the insert without interference by the handle. Notice that while the insert 10 is shown in the drawings in an application with a sliding door that opens to the right, it is equally suitable for use with a left-handed door because its interior and exterior features are the same. Thus, the insert can be used interchangeably for any door of the same height. The flanges 40 protrude at least one inch, but preferably two to three inches, from the side portion 22, so that they may firmly encase the vertical edge of the abutting panel of the sliding door.

Figure 4:
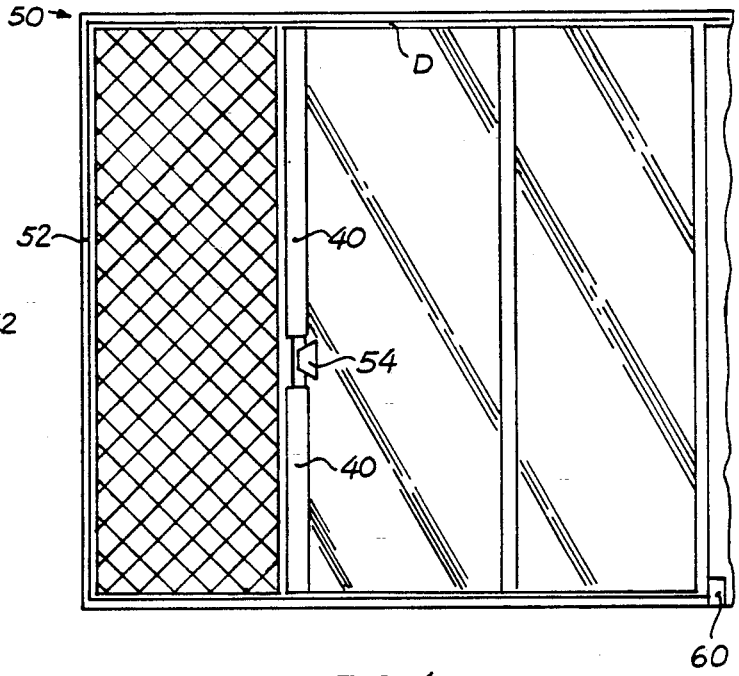
FIG. 4 illustrates the same security screen in use in a conventional sliding door.

As illustrated in use in FIG. 4, the screen insert 10 is inserted into the upper and lower trackways of a conventional sliding door. After opening the sliding panel D of the door sufficiently to permit a user to first introduce and then lift the upper portion 28 into the top track, the bottom portion 24 is lined up with and allowed to drop into the bottom trackway, according to the procedure normally required to install the panels of the sliding door itself. The insert 10 is then pushed against the jamb 52 of the door frame 50, so that the two structures abut in the same manner as the door would upon closing and the insert's vertical portion 26 engages the groove normally present in door jambs. The sliding-door panel D is then closed to butt against the portion 22 of the insert, allowing the door handle 54 to fit into the gap formed by the discontinuity 42 in the lateral flanges 40. Finally, further movement or travel of the door is prevented by any of the auxiliary means 60 normally used for securing sliding doors and windows. These are available in the form of anti-slide blocks, slide bolts, and auxiliary latches that fasten to the trackway of the sliding door, thus preventing its travel beyond their position. If no such means is available, the travel of the door may be prevented by drilling a pinhole through the frame and the sliding panel of the door after the insert is installed to form a continuous closure, and then by inserting a pin therethrough to lock it in place. Obviously, such makeshift locking device could be located anywhere along the top or bottom portion of the sliding door, so long as away from the reach of a person trying to unlock it from outside the screen. As probably seen in most households in the United States, another homemade contraption that could be used is a pole jammed in the way of the travel of the door to prevent it from being opened past the desired position.

It is readily apparent that the resulting screen-door assembly provides a secure opening for natural ventilation of the interior premises. Because of the vertical support provided by the flanges 40, the screen insert 10 cannot be removed simply by lifting it out of its tracks reversing the procedure followed to assemble it in place. As a result of their retaining action, so long as the door is kept within the reach of the flanges, the screen cannot be removed without also removing the door itself.

Thus, the screen insert of this invention provides a safe ventilation apparatus for temporary use in conjunction with standard sliding doors. It can be installed quickly, without requiring any bolting operation, and it can similarly be promptly removed and stowed away. Once in place, it cannot be taken out from either side of the door without opening its sliding panel at least to the point of clearing both the vertical flanges and the depth in the groove in the door jamb. This renders the insert of the invention virtually immovable under normal circumstances and impossible to extract from the door tracks. In contrast, the inserts found in the prior art can only be secured to the extent that they retain their engagement with the door jamb. A small amount of play in the continuity of the closure is usually sufficient to enable an intruder to loosen the insert out of the jamb and then lift it out of the trackways.

Figure 5:
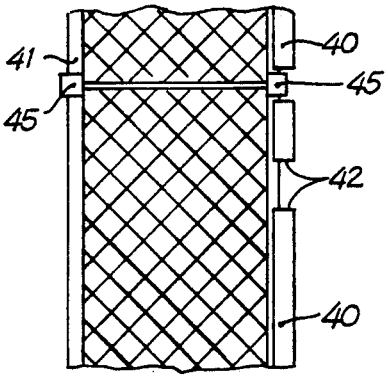
FIG. 5 illustrates, in part, an elevational side view of a second embodiment of the invention featuring a foldable frame.
Figure 6:
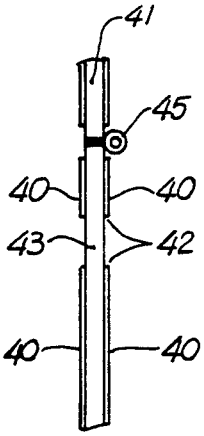
FIG. 6 illustrates a side view, taken from the left, of the embodiment of the invention shown in FIG. 5.

In order to facilitate the storage of the screen insert of this invention, the frame 20 can be divided into two or more sections connected by hinges, so that the unit can be folded into a shorter structure. As shown in the partial elevational views of FIGS. 5 and 6 for a two-section insert, such an embodiment comprises two frames 41 and 43, preferably of equal size, and any means 45 (such as standard hinges) for pivotally fastening them together so that the top section may be folded 180 degrees over the bottom section. Although not illustrated in the drawings, retaining pins or equivalent hardware, of the type that would be obvious to one skilled in the art, could be used in conjunction with the hinges to lock the screen in its open position, so as to provide a rigid unit that would be more convenient to handle during installation and removal. Of course, three or more sections could similarly be used and hinged together by those skilled in the art to yield a yet more compact unit for storage. Separate flanges 40 necessarily have to be affixed to each section and sufficient space must be present between them to permit the unobstructed folding of the various parts.

Figure 7:
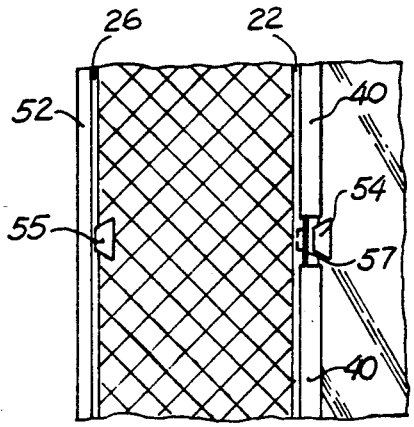
FIG. 7 illustrates a partial view of another embodiment of the invention incorporating locking hardware and a door handle.

In another embodiment of the invention illustrated in the partial view of FIG. 7, the insert described above can be equipped with locking hardware, such as a jamb plate 57, a locking mechanism (not seen) and a door handle 55, compatible with the type normally found on sliding doors. By providing a locking mechanism that could not be opened from the outside by reaching through the screen, such hardware would make it possible to fasten the insert to the lock plate in the jamb of the door, and in turn to lock the door into the insert, thus eliminating the need for securing the sliding door in position after the installation of the screen.

It is anticipated that the general structure described herein would be implemented in a variety of ways depending on the overall size and use characteristics for which the screen insert is intended. For example, any material used in the construction of door frames would be suitable for the frame of the insert. The lattice of the screen itself, on the other hand, cannot consist of the flexible type of material normally used for conventional protective screens. Rather, it must be rigid and capable of withstanding the kind of abuse that it would be likely to subjected to by a potential intruder.

Various other changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus and methods.

I claim:

1. A sliding-door security screen insert assembly for providing ventilation comprising, in combination:

a sliding door disposed within a framework having an upper and a lower horizontal trackway for sliding movement therein, said framework further having a vertical jamb with a lock plate and said door having a locking mechanism for locking said sliding door to said vertical jamb in the framework;

a handle mounted on said sliding door for effecting the sliding movement thereof within said framework;

a substantially rectangular insert frame having two vertical portions and two horizontal portions rigidly encasing a sturdy screen lattice sufficiently small to prevent the passage therethrough of people, animals and objects, wherein the vertical portions of said rectangular insert frame are approximately equal in length to the height of said sliding door and wherein the thickness of said rectangular insert frame is uniform and substantially the same as that of said sliding door, said insert frame being removably disposed in said framework within a space created by opening said sliding door;

vertical lateral flanges fastened on both sides of the vertical portion of said insert frame that faces said sliding door to ensure a strong cooperative engagement between said insert frame and said sliding door; and means for securing said sliding door in closed position against said insert frame in said framework.

2. The assembly defined in claim 1, further comprising:

an additional fine-mesh screen overlaid on said sturdy screen lattice encased by said insert frame.

3. The assembly defined in claim 1, wherein each of said vertical lateral flanges consists of a top portion and a bottom portion above and below, respectively, the location of said handle mounted on said sliding door, so that the door can be pushed all the way to butt against the edge of said insert frame without interference by said handle.

4. The assembly defined in claim 3, wherein said vertical lateral flanges protrude at least one inch, so that they may wrap around said sliding door.

5. The assembly defined in claim 3, wherein said insert frame consists of multiple sections pivotally connected to one another by fastening means that allow each section to fold 180 degrees over the adjacent section, so that the insert frame can be folded into a shorter structure, and wherein separate flanges are affixed to each of said multiple sections.

6. The assembly defined in claim 5, wherein said fastening means consists of hinges.

7. The assembly defined in claim 1, wherein said insert frame is divided into a top frame and a bottom frame of approximately equal size, connected by means for pivotally fastening them together so that the top frame may be folded 180 degrees over the bottom frame, and wherein separate flanges are affixed to each frame.

8. The assembly defined in claim 7, wherein said means for pivotally fastening said two frames together consists of hinges.

9. The assembly defined in claim 8, further comprising:

an additional fine-mesh screen overlaid on said sturdy screen lattice encased by said insert frame.

10. The assembly defined in claim 9, wherein said insert frame is approximately 80 inches high and between one and three feet wide.

11. The assembly defined in claim 10, wherein said flanges are between one and three inches wide.

12. The assembly defined in claim 1, further comprising a jamb plate and a locking mechanism mounted on said insert frame to make it possible to fasten said insert frame to the lock plate in said framework, and in turn to lock said sliding door to the jamb plate on said insert frame, thus eliminating the need for said means for securing said sliding door in closed position against said insert frame in said framework.

13. The assembly defined in claim 1, wherein said screen lattice consists of wrought iron.

14. The assembly defined in claim 1, wherein said means for securing said sliding door in closed position against said insert frame in said framework consists f anti-slide blocks fastened to said trackways.

15. The assembly defined in claim 1, wherein said means for securing said sliding door in closed position against said insert frame in said framework consists of a pole jammed in the way of the travel of the door to prevent it from being opened.

16. The assembly defined in claim 4, wherein said means for securing said sliding door in closed position against said insert frame in said framework consists of anti-slide blocks fastened to said trackways.

17. The assembly defined in claim 4, wherein said means for securing said sliding door in closed position against said insert frame in said framework consists of a pole jammed in the way of the travel of the door to prevent it from being opened.

* * * * *